US006964395B1

(12) United States Patent
Lewis et al.

(10) Patent No.: US 6,964,395 B1
(45) Date of Patent: Nov. 15, 2005

(54) DISPENSER FOR ROLLED SHEET MATERIAL

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/881,172

(22) Filed: Jun. 30, 2004

(51) Int. Cl.[7] ..... B65H 16/02
(52) U.S. Cl. ..... 242/593
(58) Field of Search ..... 242/593, 597.5, 242/597.6, 597.8, 597; 206/409

(56) References Cited

U.S. PATENT DOCUMENTS

| | | | |
|---|---|---|---|
| 3,523,653 | A | 8/1970 | Hansen |
| 3,627,216 | A | 12/1971 | Ekuan |
| 3,877,576 | A | 4/1975 | Kishi et al. |
| 3,923,223 | A | 12/1975 | Larsson et al. |
| 4,180,160 | A | 12/1979 | Ogawa et al. |
| 4,262,816 | A | 4/1981 | Margulies |
| 4,289,262 | A | 9/1981 | Finkelstein |
| 4,460,106 | A | 7/1984 | Moulding, Jr. et al. |
| 4,524,895 | A | 6/1985 | Lunden |
| 4,534,491 | A | 8/1985 | Norton et al. |
| 4,579,266 | A | 4/1986 | Bünger et al. |
| D285,995 | S | 10/1986 | Minost |
| D296,765 | S | 7/1988 | Urion |
| 4,756,460 | A | 7/1988 | Ornros |
| 4,760,970 | A | 8/1988 | Larsson et al. |
| 4,846,415 | A | 7/1989 | Jernberg et al. |
| 4,905,868 | A | 3/1990 | Beane et al. |
| 4,979,617 | A | 12/1990 | Benoit |
| 5,065,924 | A | 11/1991 | Granger |
| 5,131,561 | A | 7/1992 | Casperson et al. |
| 5,141,171 | A | 8/1992 | Yang |
| 5,205,455 | A | 4/1993 | Moody |
| 5,211,308 | A | 5/1993 | Decker et al. |
| 5,215,211 | A | 6/1993 | Eberle |
| 5,219,126 | A | 6/1993 | Schutz |
| D337,464 | S | 7/1993 | Giugiaro |
| D339,014 | S | 9/1993 | Giugiaro |
| D339,015 | S | 9/1993 | Giugiaro |
| 5,246,137 | A | 9/1993 | Schutz et al. |
| 5,263,607 | A | 11/1993 | Temesvary et al. |
| 5,273,184 | A | 12/1993 | Rizzuto |
| 5,310,083 | A | 5/1994 | Rizzuto |
| 5,346,064 | A | 9/1994 | Rizzuto |
| 5,370,338 | A | 12/1994 | Lewis |
| 5,480,060 | A | 1/1996 | Blythe |
| 5,560,514 | A | 10/1996 | Frazier |

(Continued)

FOREIGN PATENT DOCUMENTS

| | | |
|---|---|---|
| DE | 2222357 | 5/1972 |

(Continued)

OTHER PUBLICATIONS

ASTM Designation: D 3776-96, "Standard Test Methods for Mass Per Unit Area (Weight) of Fabric," pp. 86-89, published Jun. 1996.

(Continued)

*Primary Examiner*—William A. Rivera
(74) *Attorney, Agent, or Firm*—Sue C. Watson

(57) ABSTRACT

A dispenser adapted to dispense sheet material therefrom is provided and includes a housing having an exit port configured to support a centerflow roll of sheet material therein. The dispenser also includes a first tubular member and a second tubular member, and the sheet of material flows over at least a portion of both the first and second tubular members on a circuitous path to the exit port.

32 Claims, 8 Drawing Sheets

U.S. PATENT DOCUMENTS

| | | | |
|---|---|---|---|
| 5,577,634 | A | 11/1996 | Morand |
| 5,577,635 | A | 11/1996 | Block |
| 5,582,362 | A | 12/1996 | Johnson et al. |
| D385,734 | S | 11/1997 | Mervar et al. |
| 5,715,971 | A | 2/1998 | Morand |
| 5,749,492 | A | 5/1998 | Petterson |
| 5,762,286 | A | 6/1998 | Schutz |
| 5,762,287 | A | 6/1998 | Schutz |
| 5,765,718 | A | 6/1998 | Grasso et al. |
| 5,769,354 | A | 6/1998 | Lindh et al. |
| D396,369 | S | 7/1998 | Giugiaro |
| 5,785,274 | A | 7/1998 | Johnson |
| D403,543 | S | 1/1999 | Grasso et al. |
| 5,857,642 | A | 1/1999 | Zinnbauer |
| 5,868,346 | A | 2/1999 | Cobos |
| 6,062,422 | A | 5/2000 | Ellis |
| 6,082,663 | A | 7/2000 | Tramontina et al. |
| 6,089,499 | A | 7/2000 | Robinson |
| 6,129,240 | A | 10/2000 | Morand |
| 6,145,782 | A | 11/2000 | King et al. |
| 6,182,858 | B1 | 2/2001 | Hartog |
| 6,189,726 | B1 | 2/2001 | Fick |
| 6,267,321 | B1 | 7/2001 | Tramontina |
| D449,474 | S | 10/2001 | Conran et al. |
| 6,328,252 | B1 | 12/2001 | Neveu et al. |
| 6,354,426 | B1 | 3/2002 | Habisreitinger et al. |
| 6,575,397 | B1 | 6/2003 | Tramontina et al. |
| 6,629,667 | B2 | 10/2003 | Tramontina |

FOREIGN PATENT DOCUMENTS

| | | |
|---|---|---|
| DE | 2818757 | 11/1979 |
| EP | 0107487 | 5/1984 |
| EP | 0117567 | 9/1984 |
| EP | 0128127 | 12/1984 |
| EP | 0091411 | 12/1985 |
| EP | 0061248 | 11/1986 |
| EP | 0068722 | 4/1988 |
| EP | 0238460 | 8/1990 |
| EP | 0231183 | 1/1991 |
| EP | 0550863 | 7/1993 |
| EP | 0480848 | 1/1994 |
| EP | 0740921 | 11/1996 |
| EP | 0642317 | 2/1997 |
| EP | 0836825 | 4/1998 |
| EP | 0595779 | 4/2000 |
| EP | 1066787 | 1/2001 |
| FR | 2667853 | 4/1992 |
| FR | 2667854 | 4/1992 |
| FR | 2668694 | 5/1992 |
| FR | 2669818 | 6/1992 |
| GB | 1455216 | 11/1976 |
| GB | 2038778 | 7/1980 |
| GB | 2063213 | 6/1981 |
| GB | 2120639 | 12/1983 |
| GB | 2145693 | 9/1986 |
| GB | 2270299 | 3/1994 |
| WO | WO 93/22963 | 11/1993 |
| WO | WO 93/22964 | 11/1993 |
| WO | WO 97/21377 | 6/1997 |

OTHER PUBLICATIONS

ASTM Designation: D 5035-95, "Standard Test Method For Breaking Force and Elongation of Textile Fabrics (Strip Method)," pp. 682-688, published Jul. 1995.

TAPPI Official Test Method T 411 om-89, "Thickness (Caliper) of Paper, Paperboard, and Combined Board," published by the TAPPI Press, Atlanta, Georgia, revised 1989, pp. 1-3.

DISPENSER FOR ROLLED SHEET MATERIAL

BACKGROUND

Dispensers for centerflow rolls of sheet material products have become popular for dispensing sheet materials. Such dispensers usually do not rely on mechanical means to move or advance the roll. In a centerflow roll, the roll of sheet material product is formed with a hollow opening therethrough, and the sheets are removed from the hollow opening of a stationary roll rather than from a cylindrical outer surface of a roll which must be rotated.

Tension is desirably applied to the sheet material flowing from the roll and through an exit port of a dispenser for centerflow rolls to control the amount of sheet material withdrawn. If too little tension is applied to the sheet material, the sheet material dispenses without being separated, by perforations or other means into separate sheets, resulting in waste. Alternatively, if too much tension is applied, the sheets separate too early inside of the dispenser housing, resulting in jamming, lack of sheets for withdrawal in the exit port, and user frustration.

Accordingly, a dispenser adapted to dispense various sheet materials which are provided in centerflow rolls and which control the tension of the sheet material flowing therethrough to permit appropriate disensing would be desirable. Such a dispenser would provide one or more mechanisms to appropriately tension the sheet material flowing therethrough to allow withdrawal of one sheet at a time from a centerflow roll to prevent both user waste and frustration. In addition, such a dispenser would desirably provide some adjustment of the tension mechanism(s), to further control greater or lesser tension dependent upon the type and the characteristics of the sheet material, such as, for example, basis weight, caliper, machine direction tensile strength, tab strength, and so forth. Moreover, such a dispenser would provide dispensing of a roll which is positioned horizontally or vertically.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as grams per meter squared (gms) and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "centerflow roll" or "centerflow roll product" means sheet material wound cylindrically about a center axis but permitting the removal of material from the center or inner periphery of roll. Desirably, as the centerflow roll is consumed, sheet material eventually dispenses from the roll's outer periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

As used herein, the term "first tubular member", "second tubular member", "first member" and/or "second member" includes, but is not limited to, a cylindrically shaped element which includes an opening in at least a portion thereof. Such an element will desirably have a circular cross-section in at least a portion thereof. However, the circular cross-sectional shape is not intended as a limitation, and any shape or configuration, or combination of shapes and/or configurations may be utilized so long as the element operates as generally shown and/or described herein.

These terms may be defined with additional language in the remaining portions of the specification.

SUMMARY OF THE INVENTION

In response to the difficulties and problems discussed above, a dispenser is provided which is adapted to dispense sheet material. The dispenser comprises a housing, which includes a base configured to support sheet material thereon, a cover, and an exit port. The base includes a first tubular member having an opening therein. The cover includes a second tubular member positioned in a confronting relationship with the first tubular member. At least a portion of the second tubular member is configured to be positioned within the opening formed in the first tubular member. Sheet material disposed in the dispenser flows over a portion of the first tubular member and a portion of the second tubular member on a circuitous path to the exit port.

In another aspect of the invention, a dispenser is provided which is adapted to dispense sheet material. The dispenser comprises a housing including a base configured to support sheet material thereon, a cover, and an exit port. The base includes a first tubular member having an opening therein. The cover includes a second tubular member positioned in a confronting relationship with the first tubular member. At least a portion of the second tubular member is configured to have a smaller diameter than at least a portion of the first tubular member. Sheet material disposed in the dispenser flows over a portion of the first tubular member and a portion of the second tubular member on a circuitous path to the exit port.

In yet another aspect of the invention, a dispenser is provided which is adapted to dispense sheet material. The dispenser comprises a housing configured to support sheet material therein. The housing includes a roll base having a first tubular member and a cover having a second tubular member positioned in a confronting relationship relative to the first tubular member. The housing is formed to include an exit port. Sheet material disposed in the dispenser flows on a circuitous path from the housing, across a portion of the first tubular member and a portion of the second tubular member and through the exit port.

DETAILED DESCRIPTION

Figure 1:
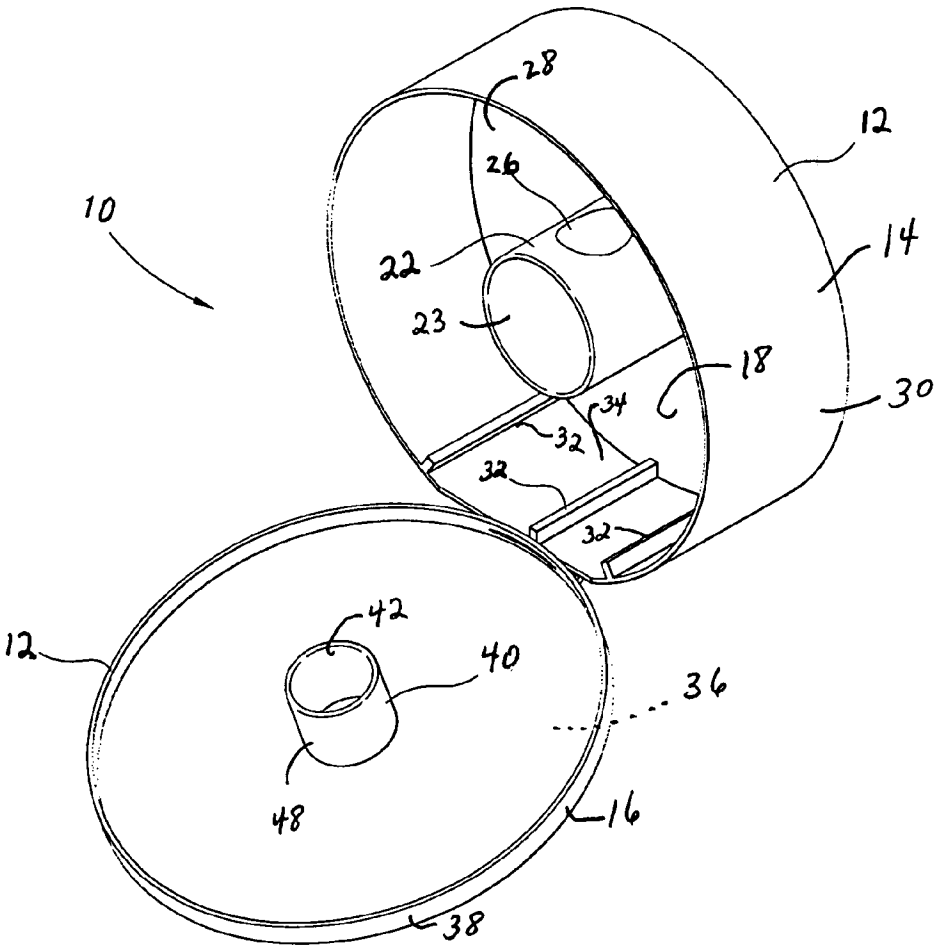
FIG. 1 is a perspective view of a dispenser for the present invention, showing the dispenser in an opened position with a cover positioned away from a roll base, the roll base having a first tubular member and the cover having a second tubular member.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Illustrated in FIGS. 1–10 is a dispenser 10 for rolled sheet material. As shown in FIG. 1, the dispenser 10 includes a dispenser housing 12. The dispenser housing 12 includes a roll base 14 and a cover 16. The housing 12 provides an internal compartment 18, and the housing 12 is configured to hold a rolled sheet material product, such as tissue, towels, and so forth, within the internal compartment 18. The dispenser housing 12 also includes an exit port 20 positioned, for example in the cover 16, although it will be understood that this position is not intended as a limitation, and the exit port 20 may be positioned on any area of the dispenser housing 12.

Figure 4:
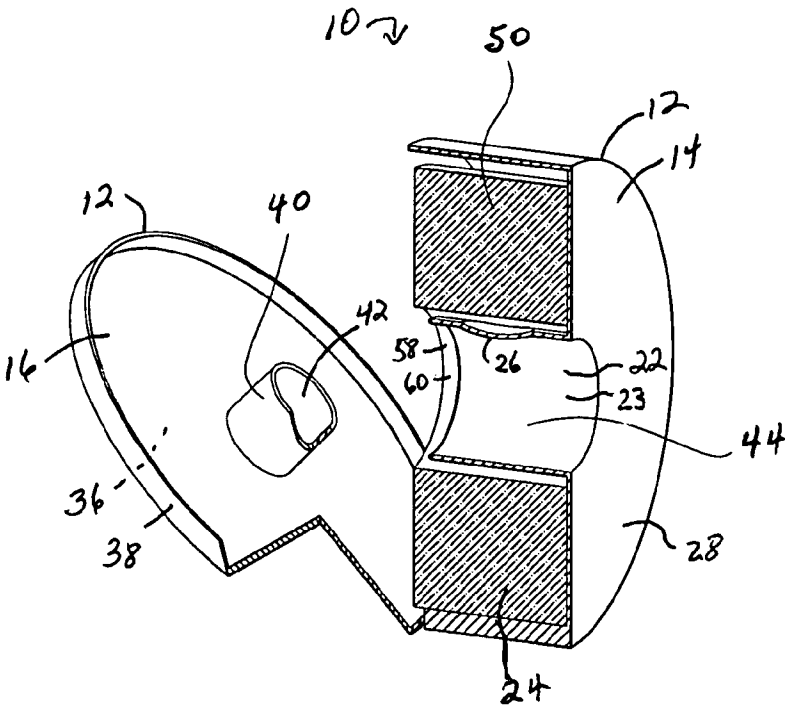
FIG. 4 is a perspective view of the dispenser of FIG. 1 showing sections of the dispenser and roll removed for illustrative purposes only to show the position of the centerflow roll relative to the first and second tubular members.
Figure 7:
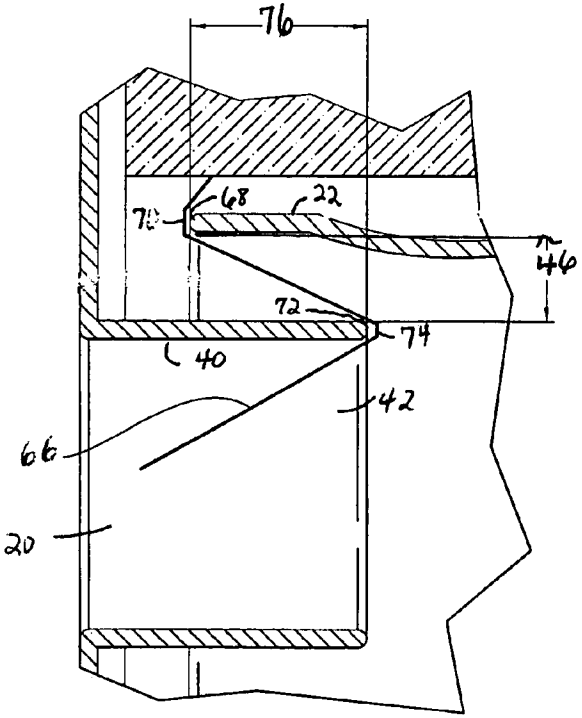
FIG. 7 is a sectional view similar to FIG. 6, but showing the path and angles over which sheet material flows from the dispenser.

The roll base 14 desirably may be configured to permit attachment of the dispenser 10 to a wall or suitable surface (not shown). The roll base 14 includes a first tubular member 22 having an opening 23 formed therein. The first tubular member 22 may be coupled to or formed integrally with the roll base 14. The first tubular member 22 desirably extends substantially through an opening in a rolled sheet material product, such as a centerflow roll 24 (FIG. 4). The first tubular member 22 desirably may include one or more cut out sections or indentation(s) 26 which are generally of a concave shape relative to the surrounding first tubular member 22. The first tubular member 22 will be discussed in further detail below.

The roll base 14 also desirably includes a back side 28 which may connect to a wall or suitable surface (not shown). A cylindrical sidewall 30 is coupled to the back side 28 or formed integrally therewith. A plurality of side ribs 32 are provided on a lower end 34 of the sidewall 30, to assist in centering a rolled sheet material product such as the centerflow roll 24 in the dispenser 10, and to reduce or prevent drag of the centerflow roll 24 on the first tubular member 22. The first tubular member 22 extends from a center of the back side 28.

The cover 16 includes a front side 36. A cylindrical lip 38 may be coupled to or integrally formed with the front side 36. A second tubular member 40 is coupled to or integrally formed with the cover 16, and extends from a center of the front side 36. The exit port 20 is provided in the second tubular member 40. The cover 16 may be connected to the roll base 14 by hinges, fasteners, and/or by any mechanism known in the art.

The cover 16, the roll housing 14, and/or any portions of either may be formed from an opaque material. Alternatively, the cover 16, the roll housing 14, and/or any portion thereof may be formed from a clear, tinted, or translucent material, so that a reduction in the centerflow roll 24 disposed in the dispenser 10 can be seen by maintenance personnel. The cover 16 is desirably rounded, to at least partially follow the curvature of the centerflow roll 24 positioned therein, although numerous other shapes may be used. Any dispenser housing, or any portion thereof shown and/or described herein is a non-limiting feature of the invention and may take any shape or configuration, in accordance with any desired functional and/or aesthetic attributes. In addition, the dispenser housing may be made of any suitable material.

Figure 2:
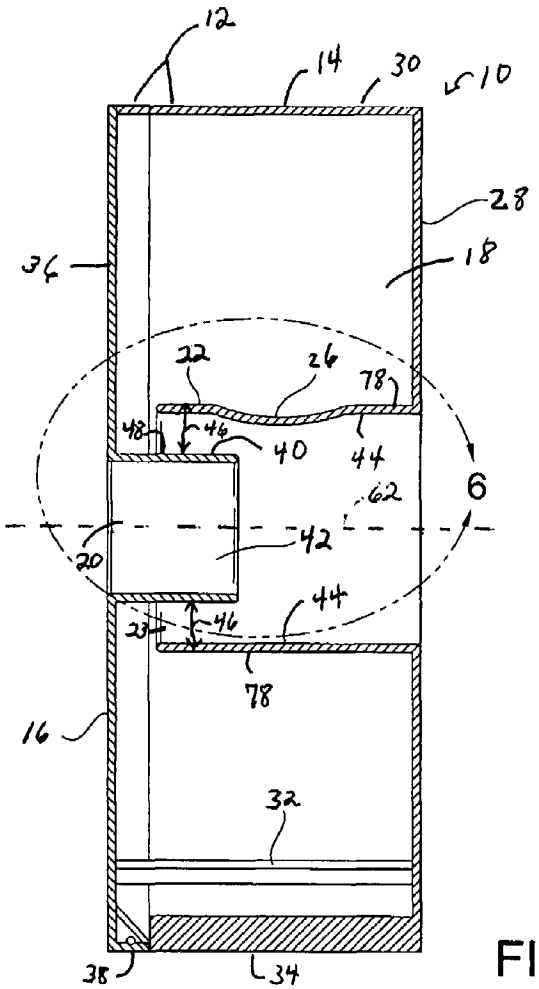
FIG. 2 is a partial sectional view of the dispenser of FIG. 1 when the cover is positioned against the roll base and the housing is closed, showing the confronting position of the first tubular member relative to the second tubular member.
Figure 9:
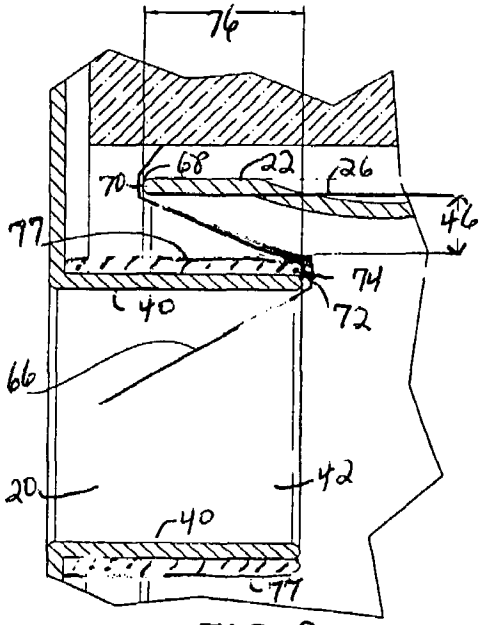
FIG. 9 is a sectional view similar to FIG. 8, but showing an alteration of the space between the first and second tubular member and its effect to alter the path of the sheet material.
Figure 8:
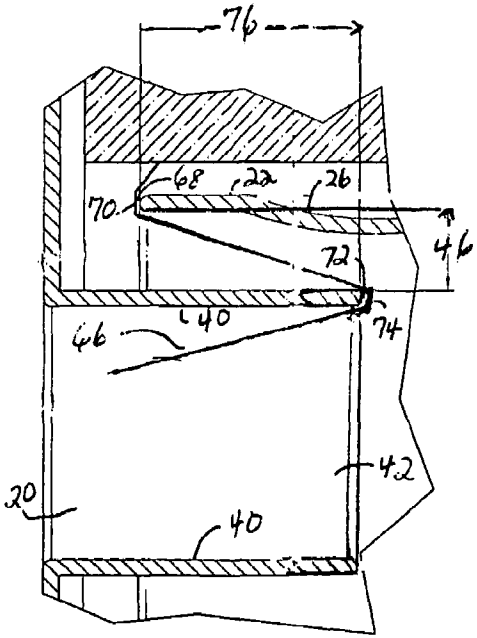
FIG. 8 is a sectional view similar to FIG. 7, but showing an alteration of the length of the second tubular member to alter the path of the sheet material.
Figure 10:
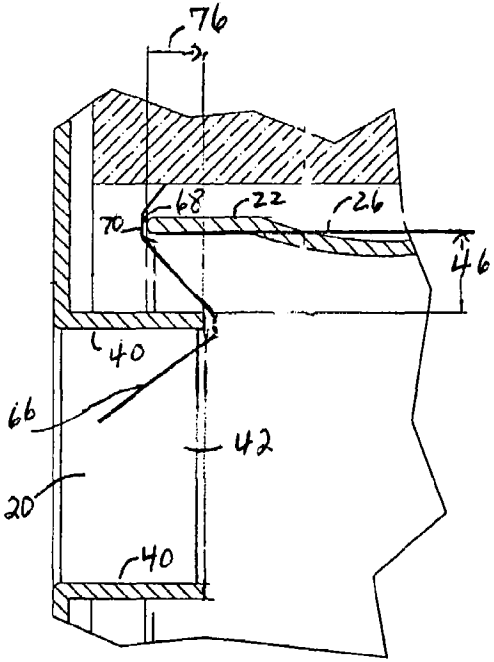
FIG. 10 is a sectional view similar to FIG. 7, but showing another alteration of the length of the second tubular member to alter the path of the sheet material.

As illustrated in FIG. 2, the second tubular member 40 is positioned in a confronting relationship relative to the first tubular member 22 and it is configured to fit inside of or within an inner wall 44 of the first tubular member 22. In addition, space 46 is provided between an outer wall 48 of the second tubular member 40 and the inner wall of the first tubular member 22, to permit sheet material 50 from the centerflow roll 24 to flow therethrough (FIGS. 6–10). The first and second tubular members 22, 40 may desirably be axially aligned as concentric tubes. Alternatively, however, the first and second tubular members 22, 40 may be provided out of axial alignment, that is, as eccentric tubes. The first tubular member 22 and/or the second tubular member 40 may be adjustable. That is, the first and/or second tubular member 22, 40 may be telescoping, have extensions which may be extended, added, or removed, or have one or more other elements which provide adjustment to the length of the first and/or second tubular member 22, 40 (FIGS. 8 and 10). Alternatively, another tubular member may be fitted within the first tubular member 22 or over the second tubular member 40 to reduce the space 46 between the first and second tubular members 22, 40 thereby providing transverse adjustability (FIG. 9). In another alternative, tubular members could be formed from circular segments radially adjustable via gearing, to increase or decrease a diameter and distance between the tubular members (not shown). It will be appreciated that such other tubular member, or other equivalent element, which operates in substantially the same manner, may be added or removed to obtain the desired adjustment.

Figure 3:
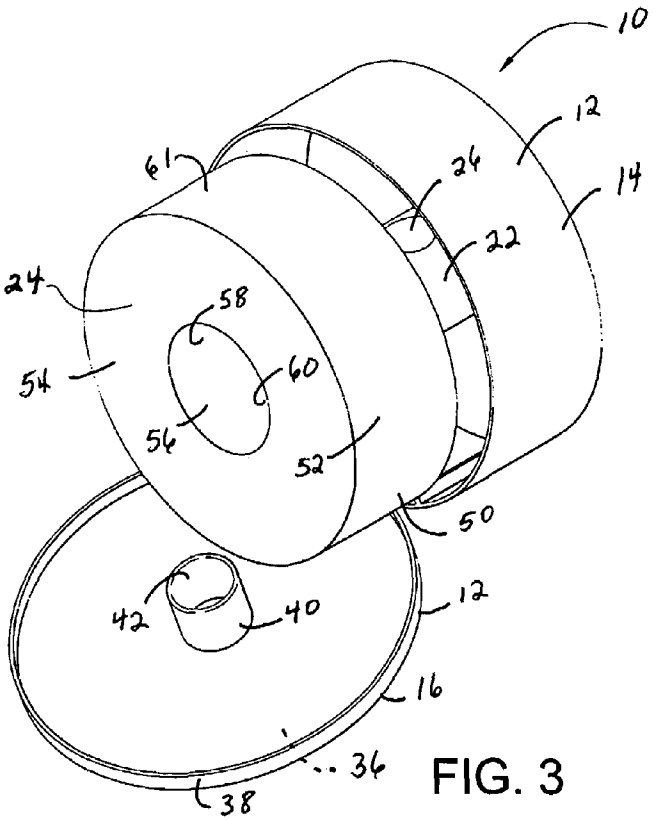
FIG. 3 is a perspective view similar to FIG. 1, but showing a centerflow roll being mounted upon the first tubular member of the roll base.

As illustrated in FIGS. 3 and 4, a centerflow roll 24 of sheet material 50 is positioned in the dispenser housing 12 of the dispenser 10. The roll 24 is shaped such that it includes an outer cylindrical body 52 positioned between flat ends 54. An opening 56 is positioned through the center of each flat end 54 and extends through the cylindrical body 52 to provide a core 58. The core 58 extends in an axial alignment through the cylindrical body 52 of the roll 24 and it defines an inner diameter 60 of the roll 24. The roll 24 is designed, but not by way of limitation, to permit sheet material 50 to flow and be withdrawn from the inner diameter 60 to an outer circumference 61 of the roll 24, thereby permitting the roll 24 to unwind with little if any movement of the roll 24 while sheet material 50 is withdrawn by a user.

The sheet material 50 may be a single ply product or a multiple ply product. The sheet material may have a single perforation or line of perforations. Alternatively, a multiply sheet material product may include one or more perforations that are offset relative to each other on two or more plies of the sheet material. One example of this offset is when a two ply sheet material product includes perforations of the second ply located in a position approximately half-way between the perforations of the first ply. When dispensed, desirably the first ply separates from the roll and half of the second ply is exposed for use. Such offset perforations are known in the art, and are disclosed and described in detail in U.S. Pat. No. 3,877,576 issued to Kishi, et al. on Apr. 15, 1975, which is hereby incorporated by reference herein in its entirety for all purposes.

The roll 24 is dispensed such that the core 58 and the inner diameter 60 is positioned over the first tubular member 22. One flat end 54 is positioned adjacent the back side 28 of the roll base 14 while the opposite flat end 54 is positioned against the front side 36 of the cover 16. The outer circumference 61 of the cylindrical body 52 is positioned adjacent the sidewall 30 of the roll base 14 and the lip 38 of the cover 16. The dispenser 10 and the roll 22 are desirably positioned such that a first axis 62 which extends through the opening 23 of the first tubular member 22 is positioned horizontally with respect to the dispenser 10 and the roll 24; the dispenser 10 is desirably, but not by way of limitation, mounted on a generally vertical surface. In this position, the indentation 26 may define a space or region into which upper layers of the roll 24 fall as the core 58 and the inner diameter 60 grows larger with removal of the rolled sheet material 50. The one or more indentation(s) 26 may tend to retain the upper layers of the roll 24 on the first tubular member 22 in a generally flat or non-bunched manner as more of the rolled sheet material 50 is pulled or withdrawn from the dispenser 10. In this manner, the upper layers of the rolled sheet material 50 are prevented from bunching or jamming within the dispenser housing 12, resulting in sheet material 50 breaking off within the internal compartment 18 and therefore causing the sheet material 50 to be inaccessible to a user (not shown). A similar tubular member with indentation is disclosed in U.S. Pat. No. 6,082,663 issued Jul. 4, 2000 to Tramontina et al., which is hereby incorporated by reference herein in its entirety for all purposes.

Figure 5:
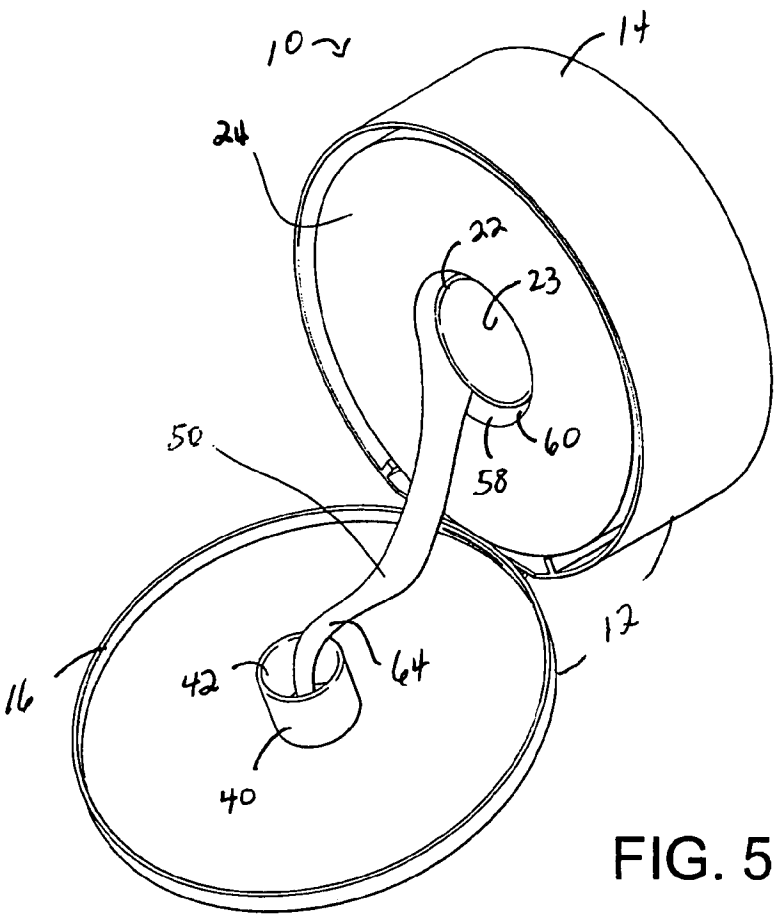
FIG. 5 is a perspective view of the dispenser of FIG. 1, showing the method of threading a leading edge of sheet material through an opening in the second tubular member.
Figure 6:
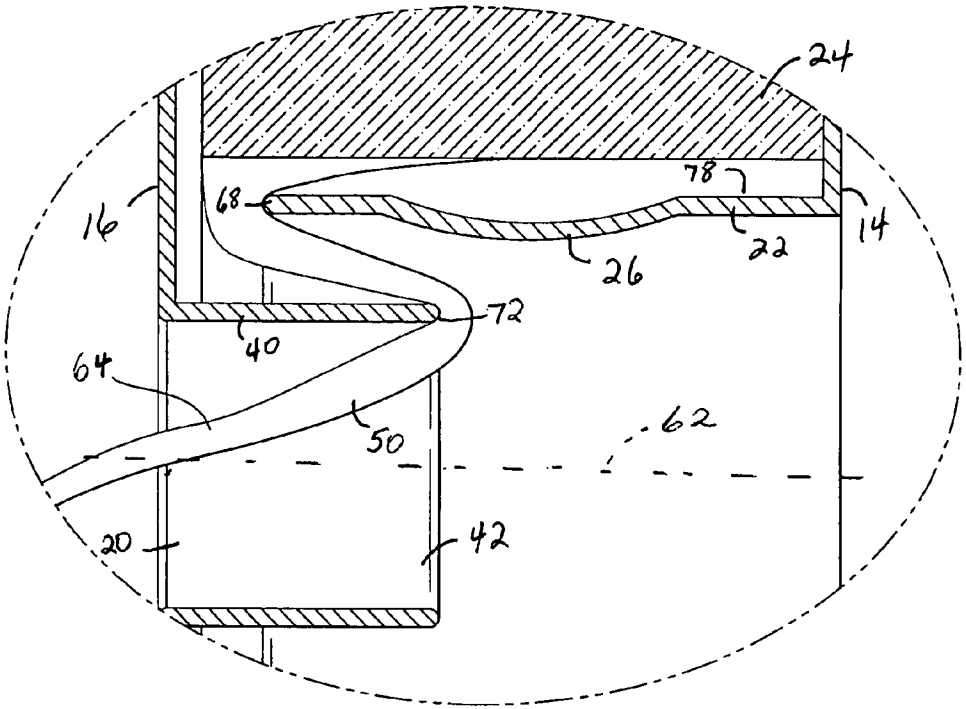
FIG. 6 is a sectional view of the dispenser of FIG. 1, showing the position of the sheet material flowing from the roll through the exit port when the housing is closed.

FIG. 5 shows a leading edge 64 of the rolled sheet material 50 withdrawn from the inner diameter 60 of the roll 24 which is adjacent the first tubular member 22. The leading edge 64 is positioned through the opening 42 in the second tubular member 40 and extends through the exit port 20, as illustrated in FIG. 6. In this manner, when the cover 16 is closed, the leading edge 64 is available to be grasped by a user so that the rolled sheet material 50 may be withdrawn from the dispenser 10.

The path followed by the sheet material 50 as it flows from the roll 24 and out of the exit port 20 is circuitous, and in this embodiment, it is shown is a serpentine path 66 which forms a sideways "S" or "Z" shape, as shown in FIGS. 6–10. That is, the sheet material 50 flows under a free end 68 of the first tubular member 22 providing a first angle 70, through the space 46 between the inner wall 44 of the first tubular member 22 and the outer wall 48 of the second tubular member 40, over a free end 72 of the second tubular member 40 providing a second angle 74, and through the opening 42 and the exit port 20. Tension or frictional resistance is applied to the sheet material 50 by the position 76 of the free end 68 of the first tubular member 22 relative to the free end 72 of the second tubular member 44, and the space 46 provided between the first tubular member 22 and the second tubular member 40.

Lengthening or shortening of the first or second tubular member 22, 40 will effect the tension or frictional resistance as will increasing or decreasing the space 46 between first and second tubular members 22, 44. Lengthening one or both free ends 68, 72 of the first and/or second tubular member 22, 40, and/or decreasing the space 46 between the first and second tubular members 22, 40, will increase the tension or frictional resistance on the sheet of material 50 by making the first and/or second angle 70, 74 more acute or decreasing the degrees of the angle(s). In an example, as shown in FIG. 8, if the free end 72 of the second tubular member 40 is lengthened, it will reduce the degrees of the second angle 74, thereby making it a more acute angle, and causing more frictional resistance against a sheet of material 50 flowing over the second angle 74. In another example, as shown in FIG. 9, decreasing the space 46 by, for example, adding another tubular member 77 over the second tubular member 40, will act to make both first and second angles 70, 74 more acute, decreasing the degrees of the angles(s) again resulting in greater tension and frictional resistance to the flow of sheet material 50.

Conversely, decreasing the length of one of both of the free ends 68, 72 of the first and/or second tubular members 22, 40 and/or increasing the space 46 between the first and second tubular members 22, 40 will decrease the tension and frictional resistance on the sheet of material 50 by decreasing the acuteness or the degrees of the first and/or second angles 70, 74. In yet another example, as shown in FIG. 10, the length of the free ends 68 and 72 of the first and second tubular members 22, 40 are decreased, therefore making the first and second angle 70, 74 less acute by increasing the degrees of each angle 70, 74, thereby permitting the sheet material 50 to flow more freely thereover. It will be appreciated that different combinations may be used to obtain the desired tension or frictional resistance appropriate for withdrawal of the sheet of material 50 from the roll 24, i.e., one sheet at a time. Such adjustability reduces waste from excessive dispensing and frustration from sheet material which breaks off within the dispenser housing 12 and is therefore not available to be dispensed to a user. Such tension and frictional resistance control and adjustment may also be based upon the characteristics of the sheet of material, such as, for example, basis weight, caliper, machine direction tensile, tab strength, and so forth.

Adjustment to cause one or more angles 70, 74 to become more acute or have fewer degrees in the angle(s) is used with a thicker, increased basis weight and/or increased caliper sheet material, resulting in greater tension and greater frictional resistance to provide appropriate withdrawal or dispensing. Adjustment to cause one or more angles 70, 74 to become less acute or to have more degrees in the angle(s) is used with a thinner, decreased basis weight and/or decreased caliper sheet material, resulting in less tension and less frictional resistance to permit appropriate dispensing. That is, thicker sheet material requires greater resistance to dispense properly; thinner, weaker sheet material requires less resistance to dispense properly.

In a method of installing sheet material 50 in a dispenser 10 as illustrated in FIGS. 3–6, a dispenser 10 having an exit port 20 is provided. Maintenance personnel open the dispenser housing 12 by moving the cover 16 at least partially away from the roll base 14 to access the internal compartment 18. A centerflow roll 24 is mounted on the first tubular member 22 in a manner previously described herein and the leading edge 64 of the sheet material 50 is moved away from an outer wall 78 of the first tubular member 22 and threaded through the opening 42 in the second tubular member 40 until the leading edge 64 extends from the exit port 20. The cover 16 is then closed, which results in the second tubular member 40 being inserted into the first tubular member 22 such that the inner wall 44 of the first tubular member 22 is adjacent the outer wall 48 of the second tubular member 40 with a space 46 desirably between walls 44 and 48, and the sheet material 50 is then positioned to flow in its circuitous, serpentine path 66 out of the exit port 20.

Figure 12:
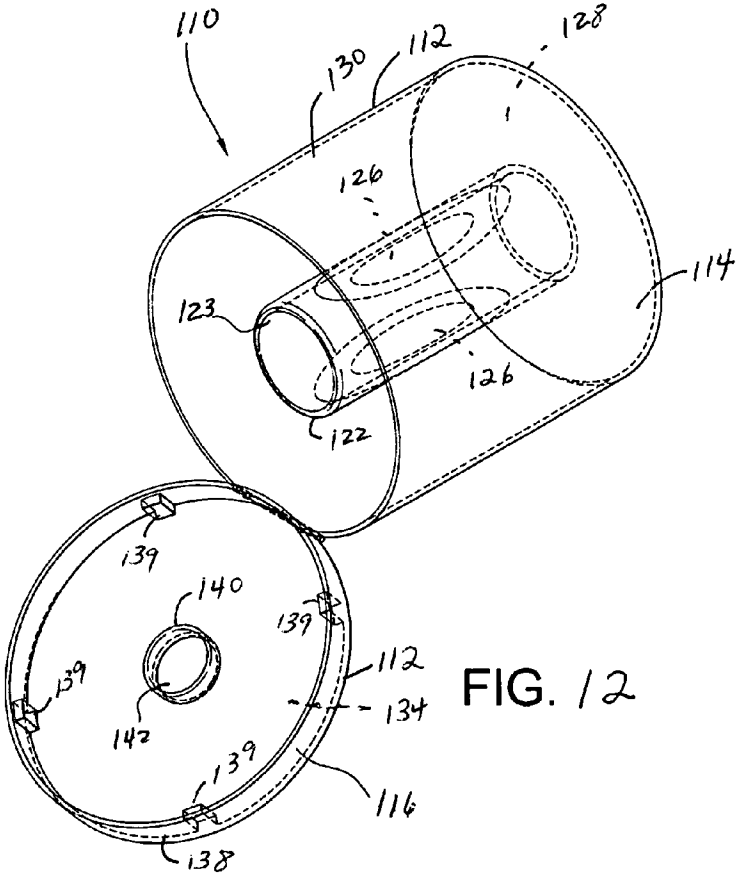
FIG. 12 is another perspective view of the dispenser of FIG. 11.
Figure 11:
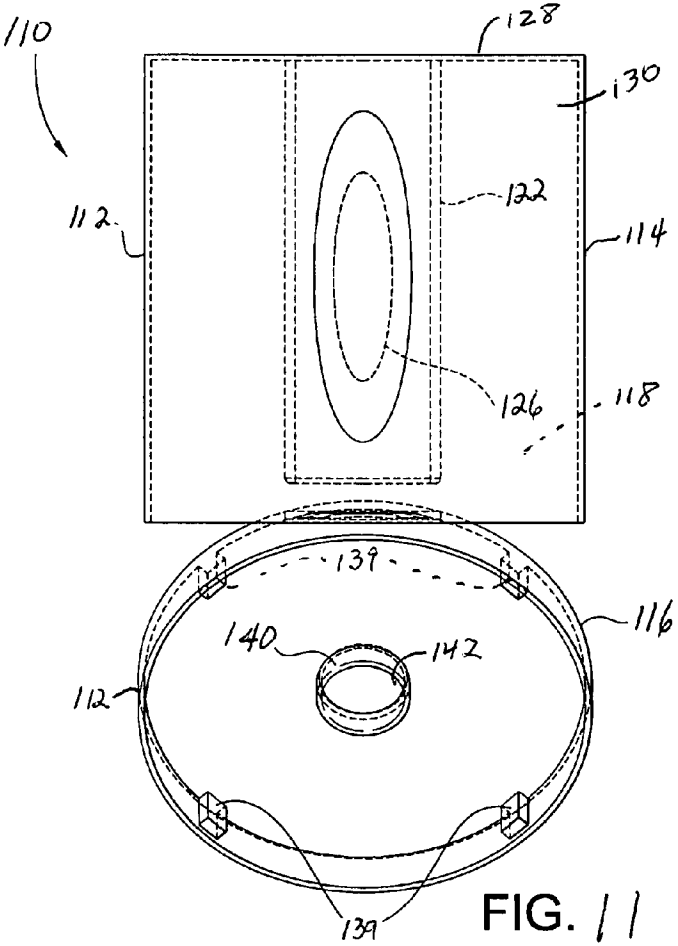
FIG. 11 is a perspective view of another embodiment of the dispenser of the present invention, showing the housing which includes the cover and the roll base.

Illustrated in FIGS. 11–19 is a dispenser 110 for rolled sheet material, which is similar to the dispenser 10 described in detail herein and shown in FIGS. 1–10, except that the dispenser 110 holds a roll 24 of sheet material 50 which is held in a vertical orientation and may desirably dispense from a lower end 134 of the dispenser 110. As shown in FIGS. 11 and 12, the dispenser 110 includes a dispenser housing 112. The dispenser housing 112 includes a roll base 114 and a cover 116. The dispenser housing 112 provides an internal compartment 118, and the housing 112 is configured to hold a rolled sheet material product, such as tissue, towels, and so forth, within the internal compartment 118. The dispenser housing 112 also includes an exit port 120 positioned, for example, in the cover 116, although it will be understood that this position is not intended as a limitation, and the exit port 120 may be positioned on any area of the dispenser housing 112.

Figure 14:
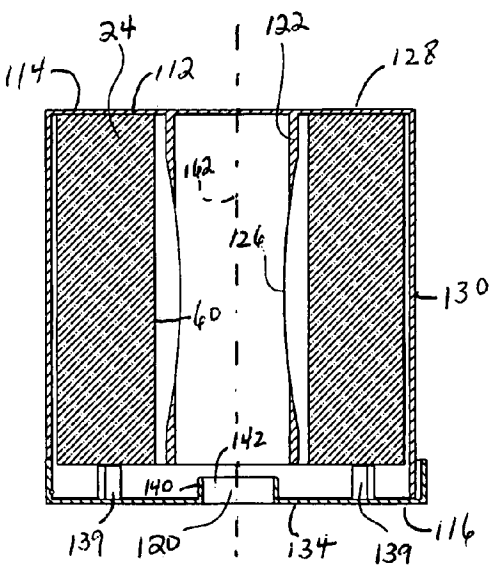
FIG. 14 is a sectional view of the dispenser of FIG. 11, showing a centerflow roll mounted within the dispenser.

The roll base 114 and/or the cover 116 may desirably be configured to permit attachment of the dispenser 110 to a wall or suitable surface (not shown). The roll base 114 includes a top side 128 having a cylindrical sidewall 130 extending therefrom. A first tubular member 122 having an opening 123 formed therein extends from a center of the top side 128 downward, generally, but not by way of limitation, in axial alignment with the cylindrical sidewall 130. The first tubular member 122 extends through the internal compartment 118 provided substantially in the roll base 114. The first tubular member 122 may be coupled to (not shown) or formed integrally with the roll base 114. The first tubular member 122 desirably extends substantially through an opening 124 in a centerflow roll 24 (FIG. 14). The first tubular member 122 desirably may include one or more cut out sections or indentation(s) 126 which are generally of a concave shape relative to the surrounding first tubular member 122.

The cover 116 also includes the lower end 134 which has a cylindrical lip 138 extending therefrom. A plurality of standoffs 139 are provided and positioned adjacent the cylindrical lip 138 to hold the outer circumference 61 of the centerflow roll 24 thereupon (FIG. 14). Alternatively, a single circular landing may be utilized as well (not shown).

A second tubular member 140 is coupled to or integrally formed with the cover 116, and is positioned generally, but not by way of limitation, in a center of the lower end 134 of the cover 116. The exit port 120 is provided through the opening 142 in the second tubular member 140, which extends through the lower end 134 of the cover 116. The roll base 114 and/or the cover 116 may be connected together by hinges, fasteners, and/or by any mechanism known in the art. The roll base 114, the cover 116, and/or any portions of either may include any characteristics described previously herein.

Figure 13:
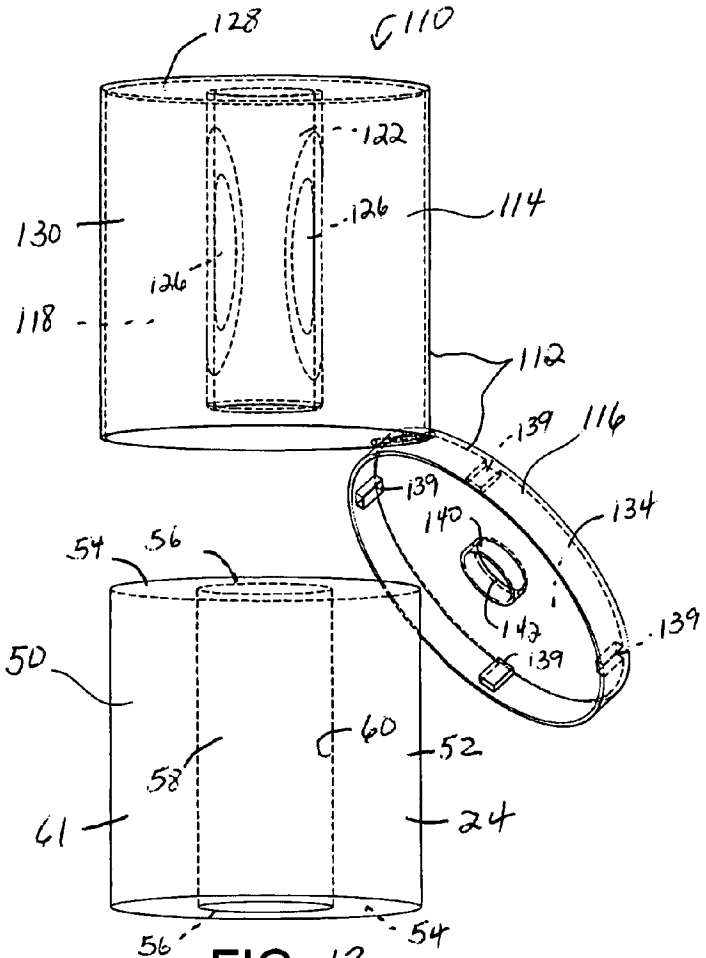
FIG. 13 is a side view of the dispenser of FIG. 11, showing a centerflow roll positioned for insertion into the dispenser.
Figure 16:
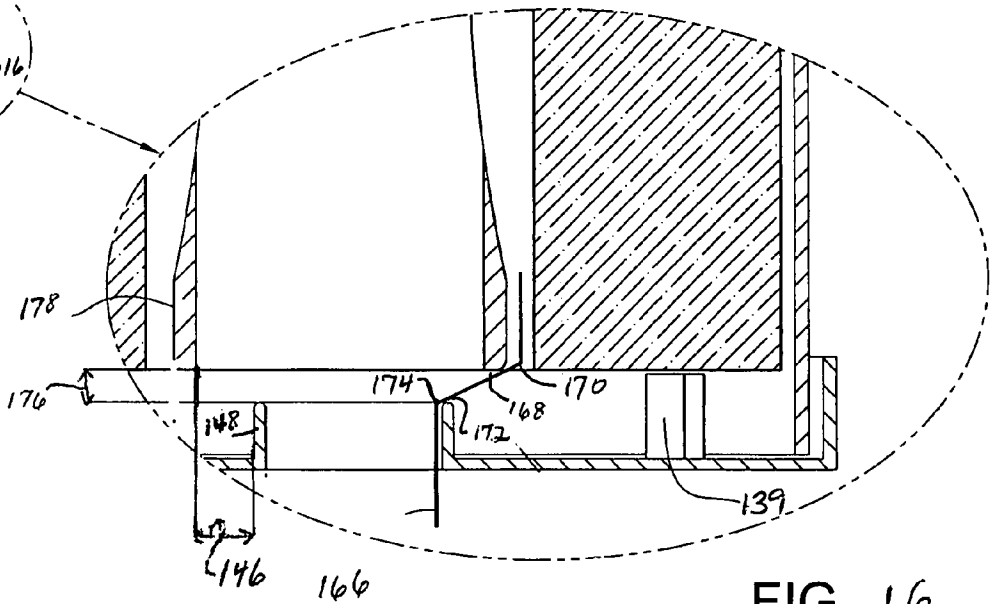
FIG. 16 is a sectional view of the dispenser similar to FIG. 11, but showing the angles and path through which sheet material flows from the centerflow roll and through the exit port.
Figure 15:
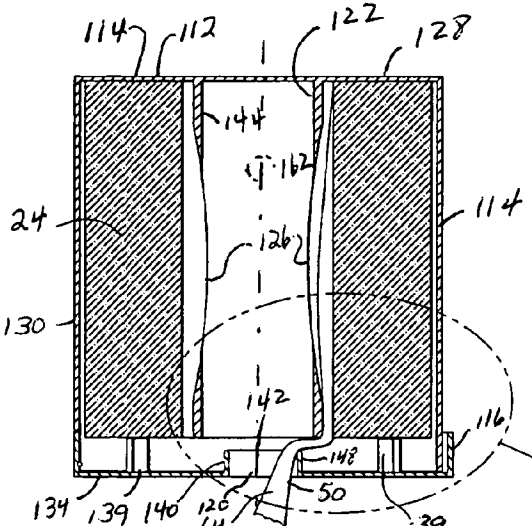
FIG. 15 is a sectional view of the dispenser similar to FIG. 14, but showing a leading edge of sheet material extending from the dispenser through an exit port.

As illustrated in FIGS. 13–14, the roll 24 is positioned upward in the dispenser housing 112 such that the first tubular member 122 is inserted through the core 58 and inner diameter 60 of the roll 24. The second tubular member 140 is configured to desirably, but not by way of limitation, be axially aligned with the first tubular member 122. It will be understood that the second tubular member 140 is configured to have a smaller diameter than the diameter of the first tubular member 122, so that the second tubular member 140 may extend into the opening 123, if desired, in the first tubular member 122. A space 146 is provided between an outer wall 148 of the second tubular member 140 and the inner wall 144 of the first tubular member 122, to permit sheet material 50 from the centerflow roll 24 to flow therethrough, as illustrated in FIGS. 15 and 16. The first and second tubular members 122, 140 may desirably be axially aligned as concentric tubes, or, alternatively, be provided out of axial alignment as eccentric tubes. The first tubular member 122 and/or the second tubular member 140 may be adjustable, as previously shown and described in detail herein.

The roll 24, when positioned in the dispenser housing 112, is dispensed such that the core 60 and the inner diameter 60 are positioned over the first tubular member 122, as previously shown and described. One flat end 54 is positioned adjacent the top side 128 of the roll base 114 while the opposite flat end 54 is positioned against the stand offs 139 positioned about the cylindrical lip 138 of the cover 116. The outer circumference 61 of the cylindrical body 52 is positioned adjacent the sidewall 130 of the roll base 114 and the lip 138 of the cover 116. The dispenser 110 and the roll 24 are desirably positioned such that a first axis 162 which extends through the opening 123 of the first tubular member 122 is positioned generally vertically with respect to the dispenser 110 and the roll 24; the dispenser 110 is desirably, but not by way of limitation, mounted on a generally vertical surface. In this position, the indentations 126 may define a space or region into which upper layers of the roll 24 fall as the core 58 and the inner diameter 60 grows larger with removal of the rolled sheet material 50. The indentations 126 may tend to retain the upper portion of the layers of sheet material 50 on the roll 24 on the first tubular member 122 in a generally non-bunched manner as more of the rolled sheet material 50 is pulled or withdrawn from the dispenser 10. In this manner, the upper portion of the layers of the rolled sheet material 50 are prevented from bunching or jamming within the dispenser housing 112, resulting in sheet material 50 breaking off within the internal compartment 118 and therefore causing the sheet material 50 to be inaccessible to a user (not shown).

FIGS. 15 and 16 show a leading edge 64 of the rolled sheet material 50 withdrawn from the inner diameter 60 of the roll 24 which is adjacent the first tubular member 122. The leading edge 64 is positioned through the opening 142 in the second tubular member 140 and extends through the exit port 120. In this manner, when the roll base 114 and cover 116 are closed, the leading edge 64 is available to be grasped by a user so that the rolled sheet material 50 may be withdrawn from the dispenser 110.

The path followed by the sheet material 50 as it flows from the roll 24 and out of the exit port 120 is circuitous, and in this embodiment, it is shown is a serpentine path 166 which forms a sideways "S" or "Z" shape. That is, the sheet material 50 flows under a free end 168 of the first tubular member 122 providing a first angle 170, through the space 146 defined between the inner wall 144 of the first tubular member 122 and the outer wall 148 of the second tubular member 140, over a free end 172 of the second tubular member 140 providing a second angle 174, and through the opening 142 and the exit port 120.

Tension or frictional resistance is applied to the sheet material 50 by the position 176 of the free end 168 of the first tubular member 22 relative to the free end 172 of the second tubular member 144 as well, and the space 146 between the first tubular member 122 and the second tubular member 140. Lengthening or shortening of the first or second tubular member 122, 140 will effect the tension or frictional resistance as will increasing or decreasing the space 146 between first and second tubular members 122, 144, as previously shown and described in detail herein. Such tension and frictional resistance adjustability will also be based upon the characteristics of the sheet of material, as also previously described. The first and second angles 172, 174 are shown in this embodiment as obtuse angles. Alterations in the free ends 168, 172 or space 146 may increase the degrees of the angles 172, 174 making them more obtuse, or less obtuse. The angles 172, 174 may by altered to become right angles, or acute angles, as previously shown and described herein.

In a method of installing sheet material 50 in a dispenser 110, as shown in FIGS. 13, 15 and 16, a dispenser 110 having an exit port 120 is provided. Maintenance personnel open the dispenser housing 112 by moving at least one of the roll base 114 and/or the cover 116 at least partially away from the other to access the internal compartment 118. A centerflow roll 24 is mounted on the first tubular member 122 in a manner previously described herein and the leading edge 64 of the sheet material 50 is moved away from an outer wall 178 of the first tubular member 122 and threaded through the opening 142 in the second tubular member 140 until the leading edge 164 extends from the exit port 120. The roll base 114 and/or the cover 116 is then closed, which results in the roll 24 being positioned and held on the standoffs 139 as well as the second tubular member 140 being axially aligned with the first tubular member 122. In one alternative, the standoffs would be formed as multiple flexible standoffs providing a landing, which would permit easier loading by maintenance personnel (not shown). It will be understood that the first and second tubular members 122, 140 may be adjusted or extended such that, for example, at least a portion of the second tubular member 140 is positioned in the opening 123 of the first tubular member 122 (not shown). The space 146 may also be adjusted, as previously described. In either instance, the space 146 desirably between walls 144 and 148 and the first and second angles 170, 174 created by free ends 168, 172 of the first and second tubular members 122, 140, respectively, position the sheet material 50 to flow in its circuitous, serpentine path 166 out of the exit port 120. The dispenser 110 may also be reversed in positioned so that the sheet material 50 dispenses from upwardly and the lower end becomes an upper end (not shown).

While certain characteristics are described in specific embodiments, any one or more characteristics, features, and/or elements may be used in any combination in any embodiment, or to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheet material, the dispenser comprising:

a housing including a base configured to support sheet material thereon, a cover, and an exit port, the base including a first tubular member having an opening therein, the cover including a second tubular member positioned in a confronting relationship with the first tubular member, at least a portion of the second tubular member configured to be positioned within an opening formed in the first tubular member, wherein sheet material disposed in the dispenser flows over a portion of the first tubular member and a portion of the second tubular member on a circuitous path to the exit port.

2. The dispenser of claim 1, wherein at least one of the first tubular member and the second tubular member is adjustable.

3. The dispenser of claim 2, wherein the at least one of the first tubular member and the second tubular member is axially adjustable.

4. The dispenser of claim 2, wherein the at least one of the first tubular member and the second tubular member is transversely adjustable.

5. The dispenser of claim 1, wherein the first tubular member and the second tubular member are axially aligned.

6. The dispenser of claim 1, wherein the sheet material flows from the housing through the exit port in a circuitous path.

7. The dispenser of claim 6, wherein the path is a serpentine path.

8. The dispenser of claim 6, wherein the circuitous path includes at least one angle.

9. The dispenser of claim 8, wherein the circuitous path includes a first angle and a second angle.

10. The dispenser of claim 8, wherein when the at least one angle is adjusted to include fewer degrees therein, greater tension and frictional resistance is created in the flow of sheet material on the path.

11. The dispenser of claim 8, wherein when the at least one angle is adjusted to include fewer degrees therein, less tension and frictional resistance is created in the flow of sheet material on the path.

12. A dispenser adapted to dispense sheet material, the dispenser comprising:

a housing including a base configured to support sheet material thereon, a cover, and an exit port, the base including a first tubular member having an opening therein, the cover including a second tubular member positioned in a confronting relationship with the first member, at least a portion of the second tubular member configured to have a smaller diameter than at least a portion of the first tubular member, wherein sheet material disposed in the dispenser flows over a portion of the first tubular member and a portion of the second tubular member on a circuitous path to the exit port.

13. The dispenser of claim 12, wherein at least one of the first tubular member and the second tubular member is adjustable.

14. The dispenser of claim 13, wherein the at least one of the first tubular member and the second tubular member is axially adjustable.

15. The dispenser of claim 13, wherein the at least one of the first tubular member and the second tubular member is transversely adjustable.

16. The dispenser of claim 12, wherein the first tubular member and the second tubular member are axially aligned.

17. The dispenser of claim 12, wherein the sheet material flows from the housing through the exit port in a circuitous path.

18. The dispenser of claim 17, wherein the path is a serpentine path.

19. The dispenser of claim 18, wherein the circuitous path includes at least one angle.

20. The dispenser of claim 19, wherein the circuitous path includes a first angle and a second angle.

21. The dispenser of claim 19, wherein when the at least one angle is adjusted to include fewer degrees therein, greater tension and frictional resistance is created in the flow of sheet material on the path.

22. The dispenser of claim 19, wherein when the at least one angle is adjusted to include fewer degrees therein, less tension and frictional resistance is created in the flow of sheet material on the path.

23. A dispenser adapted to dispense sheet material, the dispenser comprising:

a housing configured to support sheet material therein, the housing including a roll base having a first tubular member and a cover having a second tubular member positioned in a confronting relationship relative to the first tubular member, the housing formed to include an exit port, wherein sheet material disposed in the dispenser flows on a circuitous path from the housing, across a portion of the first tubular member and a portion of the second tubular member and through the exit port.

24. The dispenser of claim 23, wherein at least one of the first tubular member and the second tubular member is adjustable.

25. The dispenser of claim 24, wherein the at least one of the first tubular member and the second tubular member is axially adjustable.

26. The dispenser of claim 24, wherein the at least one of the first tubular member and the second tubular member is transversely adjustable.

27. The dispenser of claim 23, wherein the first tubular member and the second tubular member are axially aligned.

28. The dispenser of claim 23, wherein the sheet material flows from the housing through the exit port in a circuitous path.

29. The dispenser of claim 28, wherein the circuitous path includes at least one angle.

30. The dispenser of claim 29, wherein the circuitous path includes a first angle and a second angle.

31. The dispenser of claim 29, wherein when the at least one angle is adjusted to include fewer degrees therein, greater tension and frictional resistance is created in the flow of sheet material on the path.

32. The dispenser of claim 29, wherein when the at least one angle is adjusted to include fewer degrees therein, less tension and frictional resistance is created in the flow of sheet material on the path.

* * * * *